US005531356A

United States Patent [19]

Baker

[11] Patent Number: 5,531,356

[45] Date of Patent: Jul. 2, 1996

[54] GOLF BALL DISPENSER

[76] Inventor: John R. Baker, 845B Stanley Ave., Evansville, Ind. 47711

[21] Appl. No.: 366,744

[22] Filed: Dec. 30, 1994

[51] Int. Cl.[6] ..... B65G 59/00

[52] U.S. Cl. ..... 221/281; 312/49

[58] Field of Search ..... 221/281, 282, 221/303, 309; 312/45, 49

[56] References Cited

U.S. PATENT DOCUMENTS

| | | | |
|---|---|---|---|
| 1,113,476 | 10/1914 | Osmer | 221/281 |
| 1,974,332 | 9/1934 | Hauck | 221/281 |
| 3,809,448 | 5/1974 | Rakaska | 312/45 |
| 4,792,057 | 12/1988 | Mizer et al. | 221/281 |

*Primary Examiner*—Kenneth Noland

[57] ABSTRACT

This invention contains and arranges spherical objects such as golf balls in an orderly manner so that the contained objects can be easily accessed. The spherical objects can be dumped in, in quantity, yet removed simply and easily one at a time.

1 Claim, 1 Drawing Sheet

GOLF BALL DISPENSER

BACKGROUND—FIELD OF THE INVENTION

This invention arranges and contains golf balls in an orderly manner so golfers can access the golf balls one at a time for practise swings or putts.

BACKGROUND—DESCRIPTION OF PRIOR ART

The current practise on driving ranges seems to be to rent a bucket of golf balls, dump them on the ground, and whale away. The golfer often has to change his stance to reach some of the balls with the tip of his club, moving the individual balls to a convenient place for the golfer to hit the ball. The present invention simplifies life for the golfer pactising swings or putts. The golfer pours the balls from the rented bucket of balls into the present invention, said balls are then available, one at a time, out the other end of the invention. The present invention is constructed in such a way that the balls are lined up in an orderly fashion at the exit end of the invention. The golfer can then use the tip end of his club to roll the ball sideways from the exit end of the invention and position the ball for his shot, without moving his feet between shots. This makes it easier for the golfer to practise his form. It also saves space in that this invention takes up less room than a bucket of balls poured on the ground.

This inventor has never seen or heard of anything like this. The inventor saw no need for a patent search as he is convinced that if anyone had invented such a handy device, it surely would have been on the market by now.

OBJECTS AND ADVANTAGES

Several objects and advantages of this invention are:

a) less area is taken up by this invention, as compared to just dumping a bucket of balls on the ground;

b) the invention can be fabricated from recycled plastics in the preferred embodiment of the invention;

c) the golfer can keep his feet in position between shots by just reaching over and tapping or rolling the ball out of the invention sideways with his golf club. With the balls just dumped on the ground, the golfer often needs to step out of position to retrieve the next ball for the next swing;

d) the invention is inexpensive, neat, convenient, space saving and facilitates the golfer's practise swings; and e) by facilitating the golfer's practise swings, the invention encourages and helps promote a healthy out-door fresh air recreation which in turns improves fitness and good health.

DRAWING FIGURES

In the drawings, closely related figures have the same number but different alphabetic suffixes.

REFERENCE NUMERALS IN DRAWINGS

10 device
11 tube assembly
11*a* standpipe
11*b* leg

11*c* clearance
11*d* stop
11*e* elliptical curve
12 stand
12*a* backplate
12*b* bottom
12*e* fastener
12*f* washer
20 funnel
30 receiver

DESCRIPTION—FIGS. 1 AND 2

Figure 2:
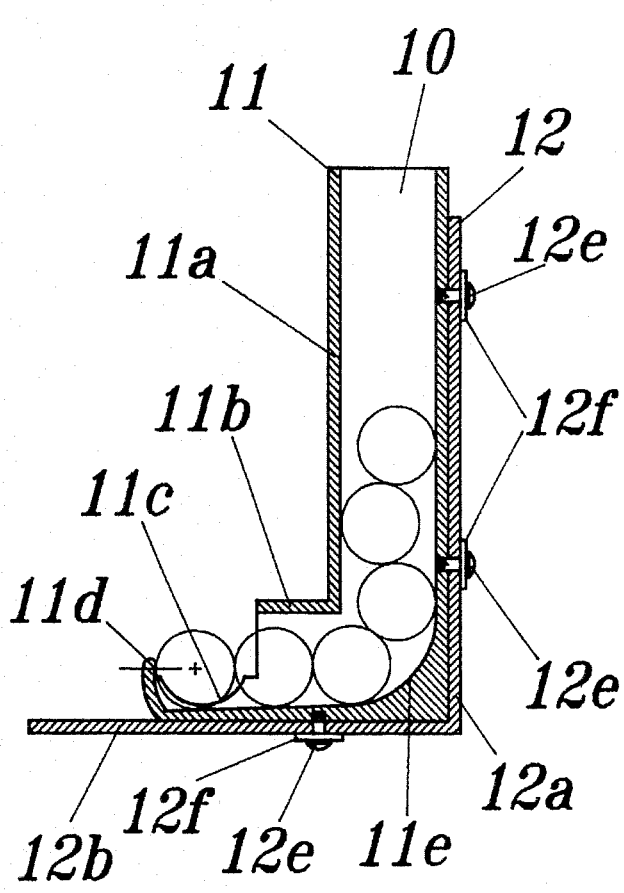
FIG. 2 shows a cross section of the invention with golf balls.
Figure 1:
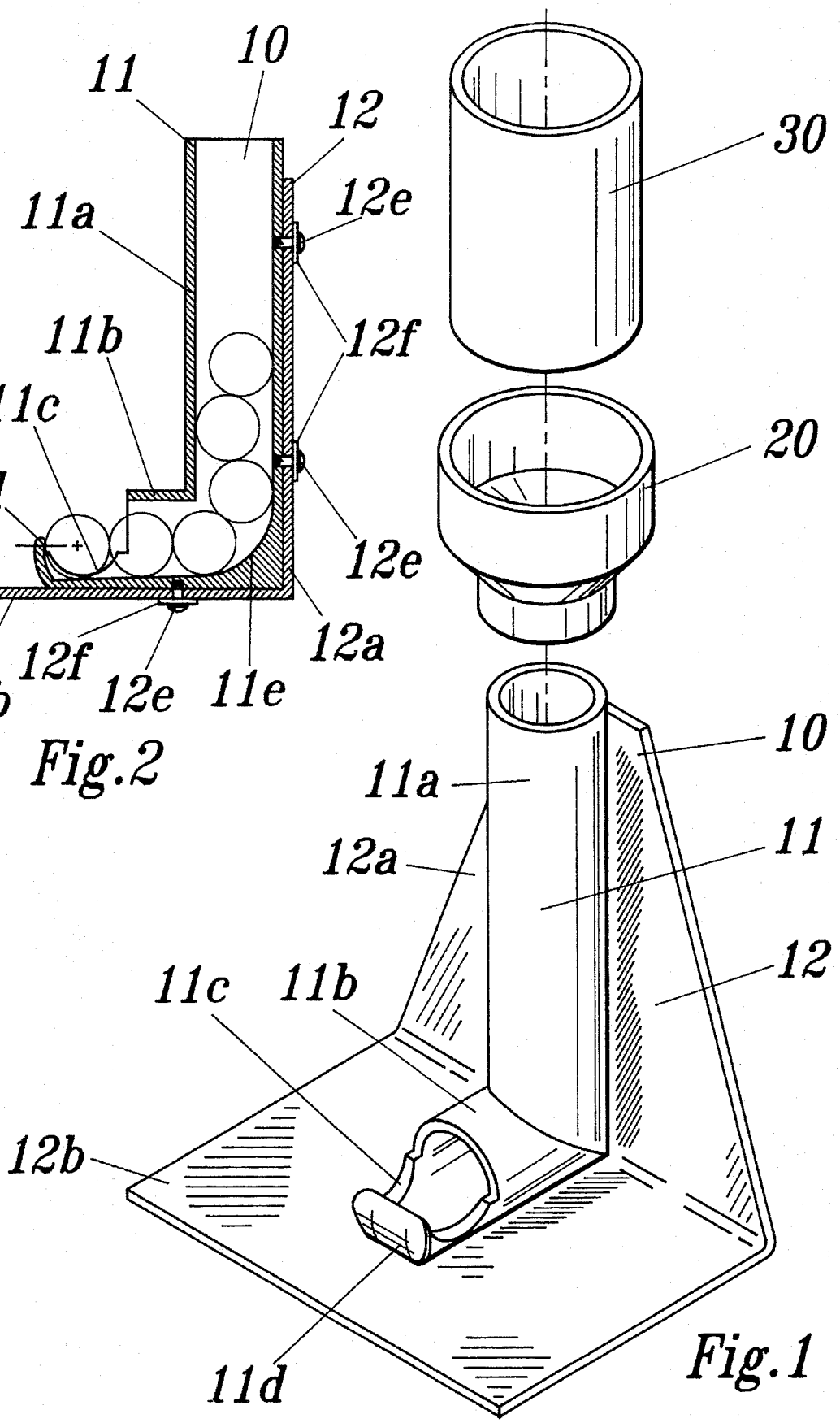
FIG. 1 shows a view of the invention.

A typical embodiment of the present invention is shown in FIGS. 1 and 2.

The device 10, includes a tube assembly 11, a stand 12, a funnel 20, and a receiver 30.

The stand 12 consists of a backplate 12*a* and a bottom 12*b*. The backplate 12*a* and the bottom 12*b* are constructed by bending a single plastic piece, in the preferred embodiment. As it is desirable for function that the stand 12 is relatively rigid, the stand 12 should be either of one piece construction or the backplate 12*a* and the bottom 12*b* should be rigidly attached to each other, in the preferred embodiment of the invention.

The tube assembly 11, includes a standpipe 11*a*, a leg 11*b*, a clearance 11*c*, a stop 11*d*, and an elliptical curve 11*e*.

The stand 12 is attaches to the tube assembly 11 by means of fasteners 12*e* through washers 12*f*. In the preferred embodiment of the invention, the washers are a soft flexible plastic. Obviously alternate embodiments would be fasteners with countersunk heads without washers if flush surfaces were desired.

The funnel 20, slips over the tube assembly 11. In the preferred embodiment, the funnel 20 rests on the edge of the backplate 12*a*.

The receiver 30 slips into the funnel 20 until the receiver 30 rests against the inward sloping portion of the funnel 20, in the preferred embodiment.

At a driving range, or prior to putting practise, the usual bucket of golf balls is dumped into the receiver 30 of the device 10. The elliptical curve 11e results in the golf balls lining up as shown in FIG. 2. The golfer can position the device 10 so that he merely reaches over manually, or with the golf club, and rolls the golf ball abutting the stop 11*d*, out of the clearance 11*c*. As there is point contact between the golf ball and the stop 11*d* as well as the adjacent golf ball which is next in line, the golf ball within the clearances rolls out quite freely.

From the FIG. 2, the long side of the elliptical curve 11*e* has a slight angle with respect to the bottom 12*b*. This encourages the golf balls to roll or otherwise be moved to the stop 11*d*. The elliptical curve 11*e*, at the juncture of the inside diameter of the standpipe 11*a* and the inside diameter of the leg 11*b* is necessary to prevent the golf balls from jamming in the tube assembly 11 at the aforesaid juncture.

In the preferred embodiment, the approximate inside diameter of the standpipe 11A as well as the end of the leg 11*b* is one and a quarter times the diameter of the golf ball.

The edge of the stop 11*d* is slightly above the horizontal axis of the center of the golf ball at the stop 11*d*. This prevents the force from the other balls forcing the golf ball at the stop 11*d* over the stop 11*d* and out of the device 10.

A cascade of golf balls could result if the edge of the stop 11*d* was lower than the center of the golf ball at the stop 11*d*.

In the preferred embodiment of the invention, recycled plastics can be used for all the parts with possibly the exception of the fasteners 12*e* and the washers 12*f*.

While the description above contains many specificities, these should not be construed as limiting the scope of the invention but as merely providing illustrations of some of the presently preferred embodiments of this invention. For example, while the invention primarily is intended for golf balls, it is quite applicable to a variety of spherical objects, such as ping pong balls, or even numbered balls used in such games as bingo or lottery. Another example is that while an elliptical curve is discussed, there are undoubtably other variations that would serve the same purpose, such as a curve at the juncture and a slight incline in the lower portion of the tube assembly. Also, adhesives might be used instead of fasteners and washers.

I claim:

1. A device for containing spherical objects such that the spherical objects can be poured into one end of said device in bulk and then removed one at a time from the other end, said device comprised of elements acting in combination as follows:

a) a tube assembly comprised of a vertical standpipe, a horizontal leg, and an inner surface with a elliptical curve, said inner surface with an elliptical curve having its long side at a slight incline so as to encourage the aforesaid spherical objects towards a stop at the lower end of the aforesaid tube assembly and said inner surface with an elliptical curve having its short side at the juncture of the vertical standpipe and the horizontal leg so that the spherical objects pass through said juncture without jamming;

b) a stand which is affixed to the tube assembly;

c) a funnel at the top of the aforesaid vertical standpipe;

d) a receiver at the top of the aforesaid funnel, into which the aforesaid spherical objects are dumped;

e) clearances in the lower end of the aforesaid tube assembly such that allow for easy removal of the aforesaid spherical objects from the aforesaid device and f) a stop at the end of the lower end of the aforesaid tube assembly.

* * * * *